US006583721B1

(12) United States Patent
Dank et al.

(10) Patent No.: US 6,583,721 B1
(45) Date of Patent: Jun. 24, 2003

(54) INTRUSION DETECTION FENCE WITH TRIP WIRES AND COMMON ACTUATOR

(75) Inventors: Hersh Yaakov Dank, Herzlia (IL); Moshe Zilberstein, Rishon LeZion (IL)

(73) Assignee: Magal Security Systems Ltd., Yehud (IL)

( * ) Notice: Subject to any disclaimer, the term of this patent is extended or adjusted under 35 U.S.C. 154(b) by 0 days.

(21) Appl. No.: 09/806,872

(22) PCT Filed: Oct. 6, 1999

(86) PCT No.: PCT/IL99/00531

§ 371 (c)(1),
(2), (4) Date: May 9, 2001

(87) PCT Pub. No.: WO00/21051

PCT Pub. Date: Apr. 13, 2000

(30) Foreign Application Priority Data

Oct. 8, 1998 (IL) ..... 126502

(51) Int. Cl.[7] ..... G08B 13/12
(52) U.S. Cl. ..... 340/548; 340/541; 340/550
(58) Field of Search ..... 340/541, 545.2, 340/548, 549, 665, 666, 668, 550; 200/61.93; 256/10, 36

(56) References Cited

U.S. PATENT DOCUMENTS

| | | | | | |
|---|---|---|---|---|---|
| 4,367,459 | A | * | 1/1983 | Amir et al. | 340/541 |
| 4,500,873 | A | * | 2/1985 | Porat et al. | 340/515 |
| 4,533,906 | A | | 8/1985 | Amir | 340/541 |
| 4,683,356 | A | | 7/1987 | Stoler | 340/541 |
| 4,829,286 | A | * | 5/1989 | Zvi | 340/541 |
| 4,829,287 | A | * | 5/1989 | Kerr et al. | 340/541 |
| 5,852,402 | A | * | 12/1998 | Perry | 340/541 |

* cited by examiner

*Primary Examiner*—Van Trieu
(74) *Attorney, Agent, or Firm*—Eitan, Pearl, Latzer & Cohen Zedek, LLP.

(57) ABSTRACT

An intrusion detection fence and system is provided. In one embodiment, the fence includes a plurality of trip wires secured between a pair of anchor posts, a plurality of detector posts anchored in the ground, located between the anchor posts, at least one actuator attached to each of the detector posts, the actuator also being coupled to each of the plurality of trip wires; and a detecting device attached to the actuator and secured to each of the detector posts. The deflection or cutting of any of the plurality of trip wires activates at least one of the detecting devices adjacent to the activated trip wires.

34 Claims, 10 Drawing Sheets

INTRUSION DETECTION FENCE WITH TRIP WIRES AND COMMON ACTUATOR

FIELD OF THE INVENTION

The present invention relates to intrusion detection system in general, and specifically to fencing systems utilizing taut wires and detector devices to detect intrusion.

BACKGROUND OF THE INVENTION

Numerous types of intrusion detection fences have been developed in order to successfully detect attempts of intruders to circumvent the system. Reference is now made to FIG. 1 which illustrate a typical prior art system such as U.S. Pat. No. 4,367,459 to Amir which consists of a fence having a plurality of trip wires 12 secured between two anchored posts 14 and a detector post 16 located between the anchored posts 14. A detecting device 18 such as a transducer is fixed to the intermediate detector post 16. Typically, the anchor posts 14 are located between 30 and 60 meters apart, that is the detector post 16 is approximately 15–30 meters away from an anchor post 14. The plurality of trip wires 12 are connected to a common actuator 20, which is supported by detector post 16. Any change in the lateral tension of wire 12 due to bending or cutting of the wire, for example, is 'received' by the common actuator 20 and transmitted to the transducer (detecting device 18).

The larger the distance between detector post 16 and anchor posts 14, the less sensitive the detection system. This is especially so in the vicinity of the anchor posts 14 further away from a common actuator 20, since as a result of the lateral movement of the wire deflection adjacent to the anchor post 14 is at a minimum near the common actuator.

In order to overcome these disadvantages, wire guiding posts 22 are placed between the detector posts 16 and between the anchor post 14 and the detector posts 16 to guide the wires 12 which slide through them without being held by them (the wires are not secured to the guiding post 22).

In a further variation as illustrated in FIG. 2, it is known to use one or more helical wire supports 24 between the common actuators 20 (in place of or in addition to wire guiding poles of FIG. 1). These helical wire supports 24 also act as sliding supports which translate the vertical motion of the wires, which have been bent or cut, into a lateral movement which can be sensed by the common actuator 20 and detected by the detecting device 18 connected to the common actuator 20.

However, these helical wire supports 24 (as shown in FIG. 2) or wire guiding posts 22 (as shown in FIG. 1) have the disadvantage that they can be easily mechanically cut, broken or removed by the intruder, actions which may not trigger the alarm. Thus, if an intruder has enough time, the removing or cutting of the helical wire cases the fence to lose its sensitivity. Thereafter, the intruder can, in some situations, move the taut wires apart without triggering the detecting device 18.

U.S. Pat. No. 4,829,287 to Kerr, schematically illustrated in FIG. 3 to which reference is now made, utilizes a plurality of detector posts 30 between anchor posts (not shown) and a plurality of sensors 32 which are mounted on each detector post 30. Each of the parallel taut wires 34, anchored to the anchor posts, engage a single sensor. Between horizontally consecutive sensors, wire guiding devices comprising a rod and helical coil support members 36 (similar to FIG. 2) are placed to guide the taut wires 34, keep them apart and translate the bending movement of the wire into a lateral motion through the helical coil supports.

Intrusion detection systems having a sensor fitted to each taut wire are much more expensive, since they require a sensor for each strand of wire, and consequently also require a great deal more maintenance. Eventually, the sensor parts of the taut wire system which are relatively costly and the most vulnerable parts of the system lose their sensitivity especially if not properly maintained. Therefore, these "sensor for each wire" type systems are much more expensive in comparison to the "common actuator" type of fences mentioned above.

While the "common actuator" type fences are less expensive are generally less sensitive especially when the intruder removes or breaks the helical or guiding posts and thereby reducing the fence's sensitivity and causing the fence to deteriorate and become less effective.

SUMMARY OF THE PRESENT INVENTION

It is an object of the present invention to provide an improved intrusion detection fence utilizing a plurality of tensioned taut wires, which overcomes the limitations and disadvantages of prior art systems.

It is a further object of the present invention to improve the sensitivity of the system by reducing the opportunity for intrusion even when the intruder tries to reduce its sensitivity by removing or braking one or more of the guiding posts or helical supports. In the preferred embodiment, the intrusion detection system includes a plurality of active sensor devices each connected to a common actuator. The active sensor devices are placed between anchor posts which tautly restrain the taut wires.

There is therefore provided, in accordance with a preferred embodiment of the present invention, an intrusion detection fence, which includes a plurality of trip wires secured between a pair of anchor posts, a plurality of detector posts anchored in the ground, located between the anchor posts, at least one actuator attached to each of the detector posts, the actuator also being coupled to each of the plurality of trip wires; and a detecting device attached to the actuator and secured to each of the detector posts. The deflection or cutting of any of the plurality of trip wires activates at least one of the detecting devices adjacent to the activated trip wires.

Furthermore, in accordance with a preferred embodiment of the present invention, deflection of any of the plurality of trip wires activates each of the detecting devices either side of the activated trip wires.

Furthermore, in accordance with a preferred embodiment of the present invention, the actuator is an actuating wire tensioned between the ends of the detector post. The actuator is an actuator bar or flange.

Additionally, in accordance with a preferred embodiment of the present invention, the fence further includes a passive wire attached to each of the detecting device, the passive wire being parallel to the actuator wire.

In addition, in accordance with a preferred embodiment of the present invention, The detecting device is housed within a central leg of a generally "I" shaped housing, the housing further includes a bottom leg and a top leg attached to the central leg. The housing further includes a pair of clamps attached to the top leg for clamping common actuator wire and passive wire to the detecting device.

In addition there is also provided, in accordance with a preferred embodiment of the present invention, an intrusion detection system which includes a fence having a plurality of trip wires secured between a pair of anchor posts, a plurality of detector posts anchored in the ground, located between the anchor posts, at least one actuator attached to each of the detector posts, the actuator also being coupled to each of the plurality of trip wires, a detecting device attached to the at least one actuator and secured to each of the detector posts: and a control center coupled to each of the detecting devices. The control center includes a processor for determining and indicating the location of detecting device activated by the deflection of any of the trip wires.

In a second embodiment, in accordance with a preferred embodiment of the present invention, the system and fence further include a plurality of guiding posts, each guiding post being located between each pair of detecting posts or between a anchor post and a detecting post. The actuating wire is tensioned between the top of one of the guiding posts and the bottom of the adjacent guiding post. Alternatively, the actuating wire is tensioned between one end of one of the guiding posts and the end of one of the anchor posts.

Furthermore, in accordance with a preferred embodiment of the present invention, the fence and system further include a second detecting device attached to at least one of the pair of anchor posts.

Furthermore, in accordance with a preferred embodiment of the present invention, the actuating wire is further tensioned between the top and bottom ends of one of said pair of anchor posts and attached to the second detecting device. Alternatively, the actuating wire is further tensioned between the top or bottom end of an anchor post and attached to the second detecting device.

Furthermore, in accordance with a preferred embodiment of the present invention, the fence and system further includes a second actuating wire attached to and tensioned between the top and bottom ends of the anchor post and attached to the second detecting device.

Additionally, in accordance with a preferred embodiment of the present invention, the fence and system further includes second and third actuating wires. The second actuating wire is tensioned between one end of one of the pair of anchor posts and the third actuating wire is tensioned between the other end of the anchor post.

Furthermore, in accordance with a preferred embodiment of the present invention, the detecting devices are torque sensitive devices.

BRIEF DESCRIPTION OF THE DRAWINGS

The present invention will be understood and appreciated more fully from the following detailed description taken in conjunction with the drawings in which.

DESCRIPTION OF THE INVENTION

Figure 1:
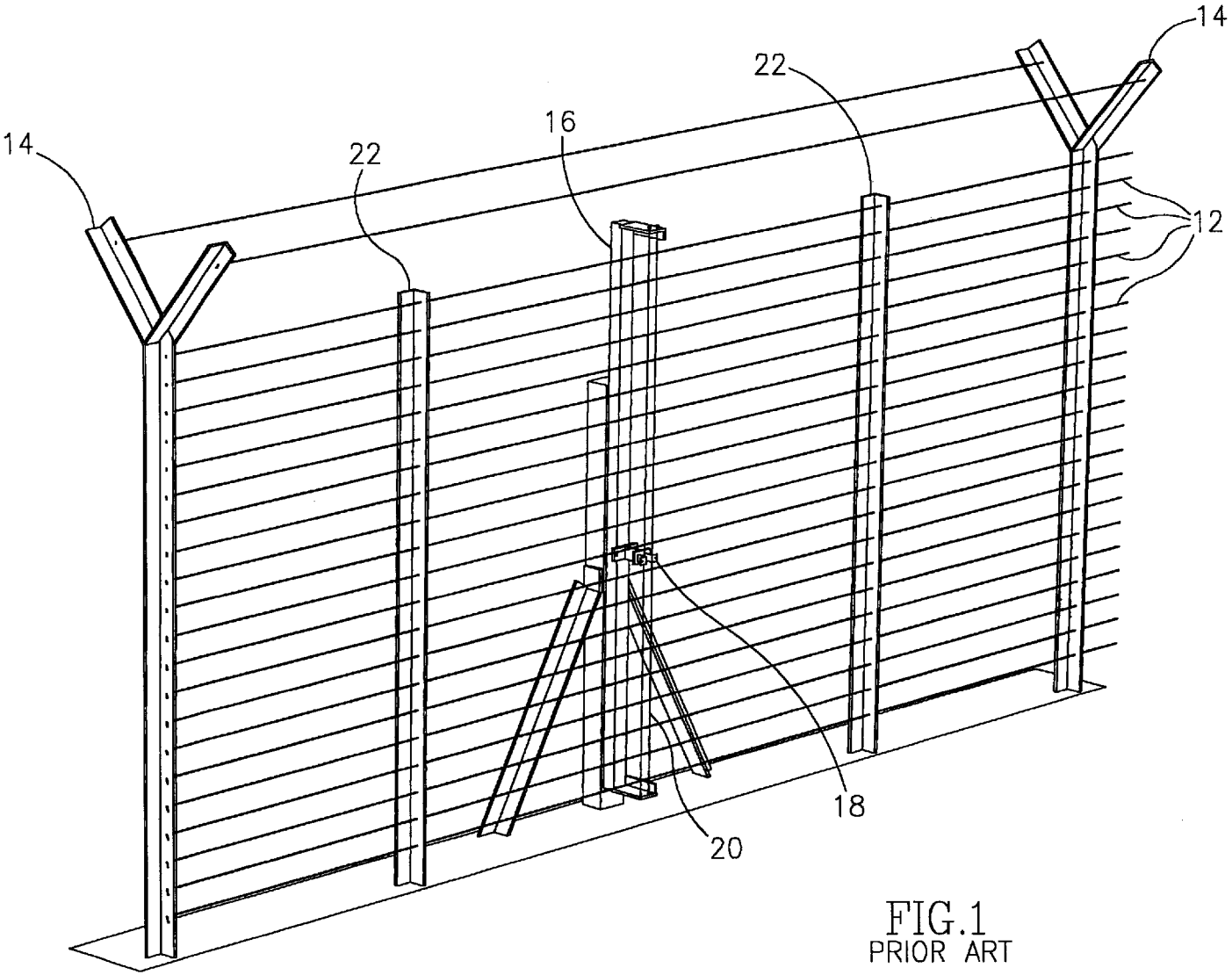
FIG.1 PRIOR ART
FIG. 1 is a isometric illustration of a prior art common actuator detection system.
Figure 2:
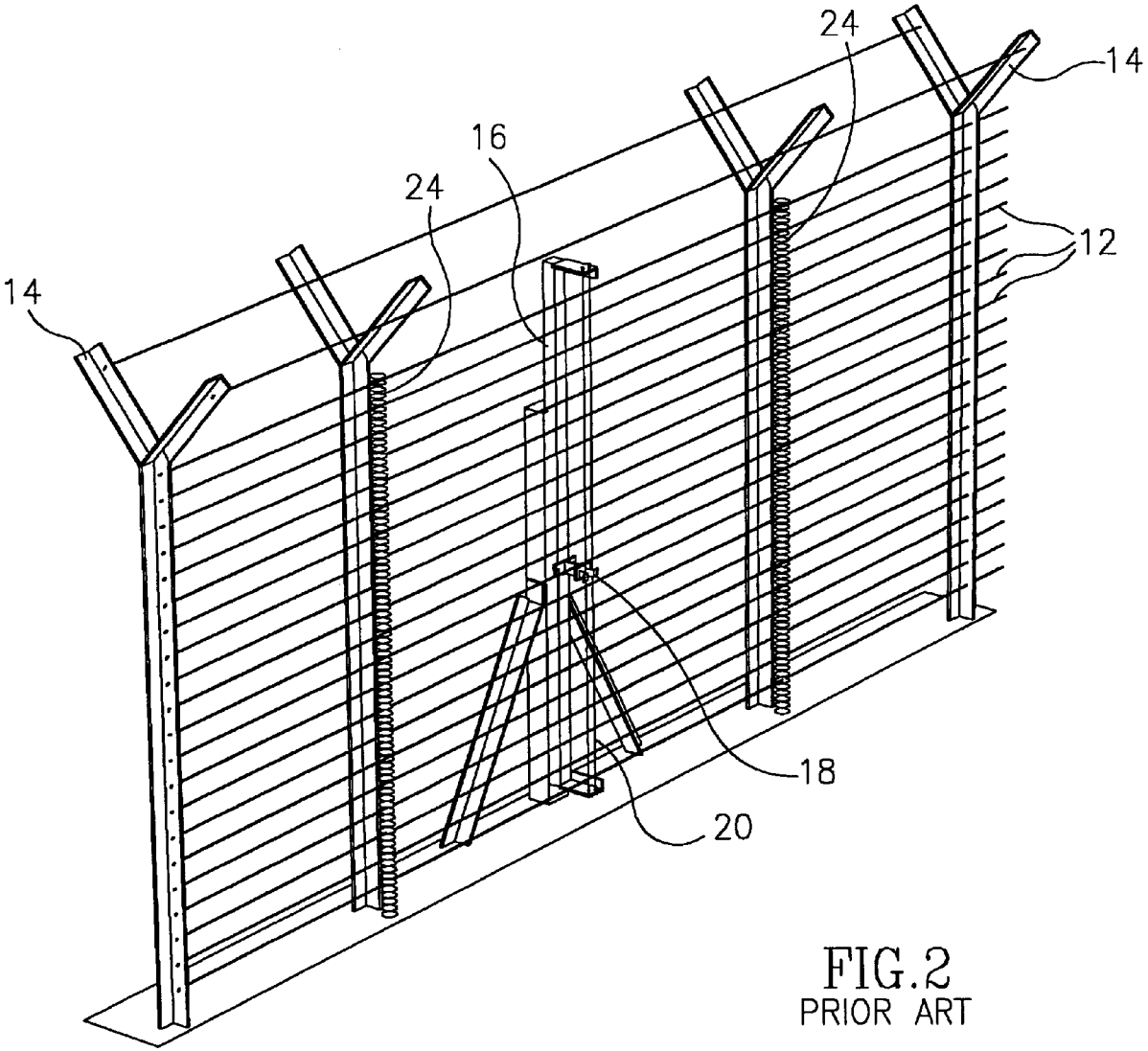
FIG.2 PRIOR ART
FIG. 2 is a isometric illustration of a further prior art common actuator detection system using helical wire guides as guiding posts.
Figure 3:
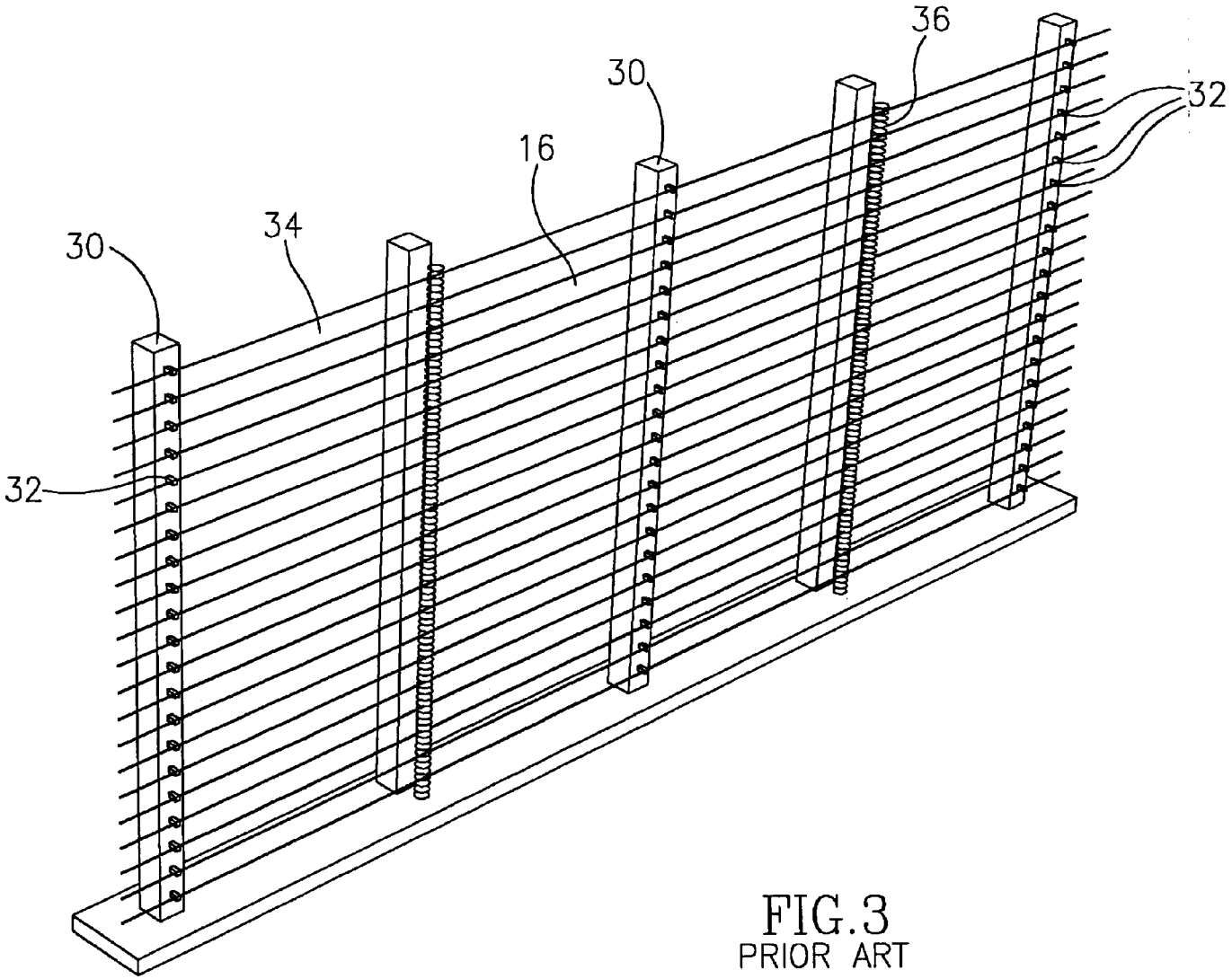
FIG.3 PRIOR ART
FIG. 3 is a isometric illustration of a further prior art detection system using a plurality of sensors on each detector post.
Figure 4:
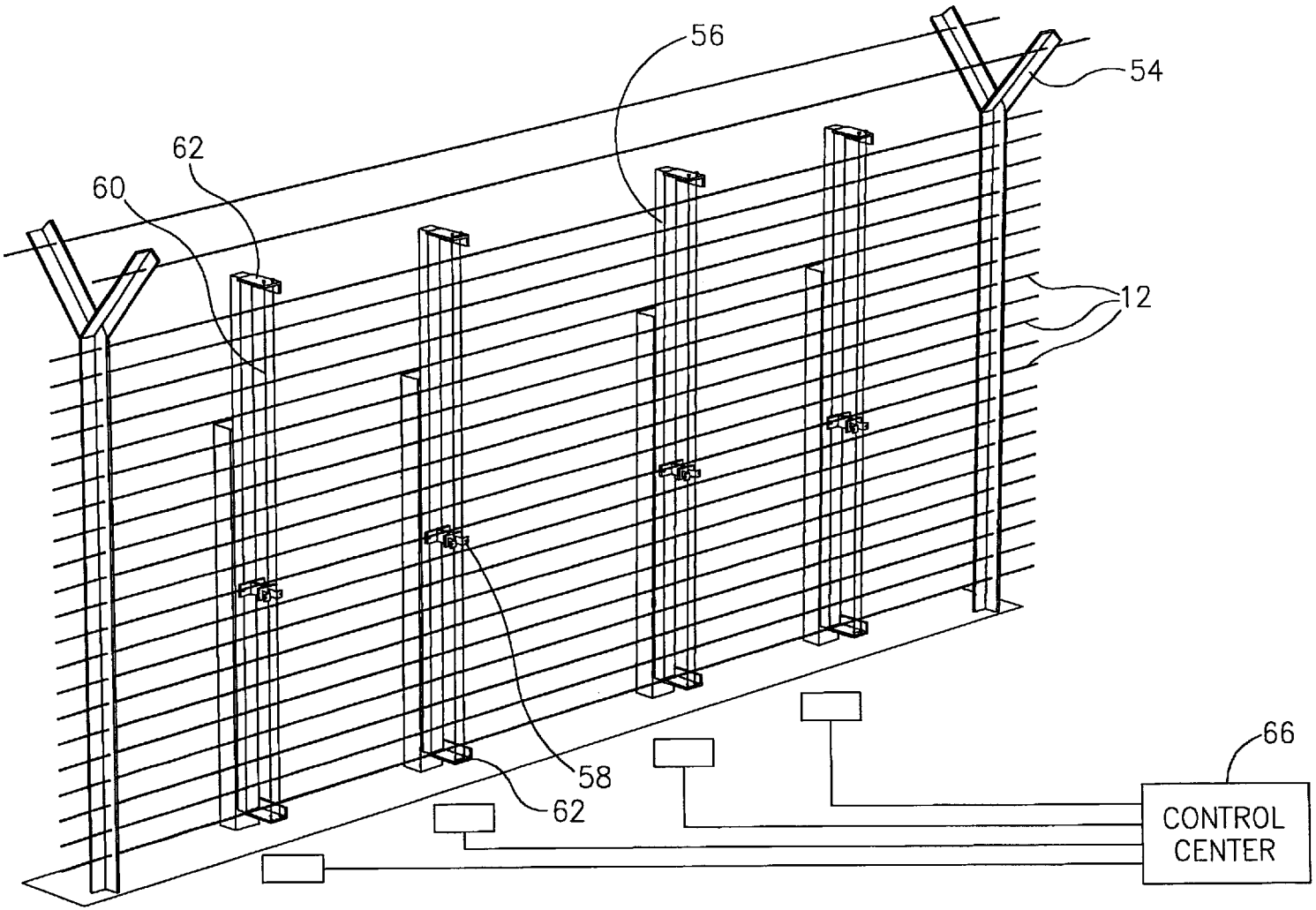
FIG. 4 is a isometric illustration of a detection system, constructed and operative in accordance with an embodiment of the present invention.

Reference is now made to FIG. 4 which is an isometric illustration of a taut wire detection system, generally indicated 50, constructed and operative in accordance with an embodiment of the present invention.

Detection system 50 consists of a fence having a plurality of trip wires 52 tautly secured between anchor posts 54. A plurality of detector posts 56, which are fixed to the ground to prevent movement, are located between anchor posts 54.

Each detector post 56 supports at least one common actuator wire 60 which is attached to each of the taut trip wires 52 by any suitable means, such as clips (not shown) which are suitably fitted around the trip wires 52. It will be appreciated by persons skilled in the art that the common actuator devices are not limited to actuator wires but also other mechanical assemblies could be applied such as bars and flanges as described in U.S. Pat. No. 4,367,459 to Amir, for example. A detecting device 58 is suitably connected to each common actuator wire 60. For the purposes of illustration only, detecting device 58 is located approximately mid-way along each common actuator wire 60. Each of the detecting devices 58 is coupled to a control center 66.

The common actuator wire 60 is suitably attached to each end of detecting post 56 such as by use of restraining brackets 62. Preferably, common actuator wire 60 can be adjusted for tension by attaching at least its lower end to a threaded pin (not shown), for example, so that by rotating the pin tension can be applied to the common actuator wire 60.

The detecting device 58 can be any suitable device which provides high sensitivity with a wide dynamic range, such as a strain gauge, which outputs an electrical signal proportional to the force applied, or piezoelectric devices The detecting device 58 is preferably preset within a predetermined operating range so that any change in the tension (plus or minus), due to cutting the wire or spreading it apart, will actuate at least one of the detecting devices 58 and probably the two detecting devices 58, on either side of the potential intrusion, In order to improve the effectiveness of the system 50, the detector posts 56 are preferably located a distance apart, which ensures that any vertical motion of the wires (owing to intrusion attempts to force the wires apart) is detected by at least one of the sensors (detecting device 58) attached to the detector posts 56. In addition, since the distance between the detector posts 56 is relatively short, each of the detecting devices 58, either side of an attempted intrusion or tampering with the wires, will be activated.

Thus, the control center 66 to which the detecting devices 58 are connected, can accurately identify the location of the attempted intrusion, allowing for a swifter response by the security forces, which is a further advantage over prior art intrusion detection fences.

The preferred distance between detector posts 56 is relatively shorter than prior art systems which means that, since the taut wires 52 are attached to the common actuators 60 every 6–8 meters, the fence is effectively more secure and less liable to natural deflection due to the distance between common actuators. The detection system 50 of the present invention has advantages over the prior art systems since the detector posts 56 cannot be disabled. The detector posts 56 are secured within the ground and each of them equipped with an active transducer 58 connected to common actuators 60, so that, in contrast to prior art systems using wire guiding poles or helical wire supports, the wires connected to the detector posts 56 do not have a sliding motion. Instead, the wires are connected to the common actuators 60. Therefore, the detector posts 56 themselves are sensitive to any movement. In addition, whenever there is tampering with the wires 52, there is a direct actuation of the detecting devices 58 close to the location of the intrusion attempt, in contrast to the indirect actuation of prior art common actuator systems which are generally located further away.

Furthermore, there is a built-in redundancy since generally at least two detecting devices 58 will be activated at any time (that is, except at the ends of fence next to the anchor posts 54) and thus if one of the detecting devices 58 is inoperative, at least one of the others will be activated. Also, though there are additional detector posts 56 and detecting devices 58, the extra cost is at least partly offset by the saving in the cost of intermediate supports (guiding posts or helical wire supports).

In addition, the extra cost is substantially less than the prior art "sensor per wire" type systems due to the fact that each detector post is itself is effectively a common actuators.

Figure 5:
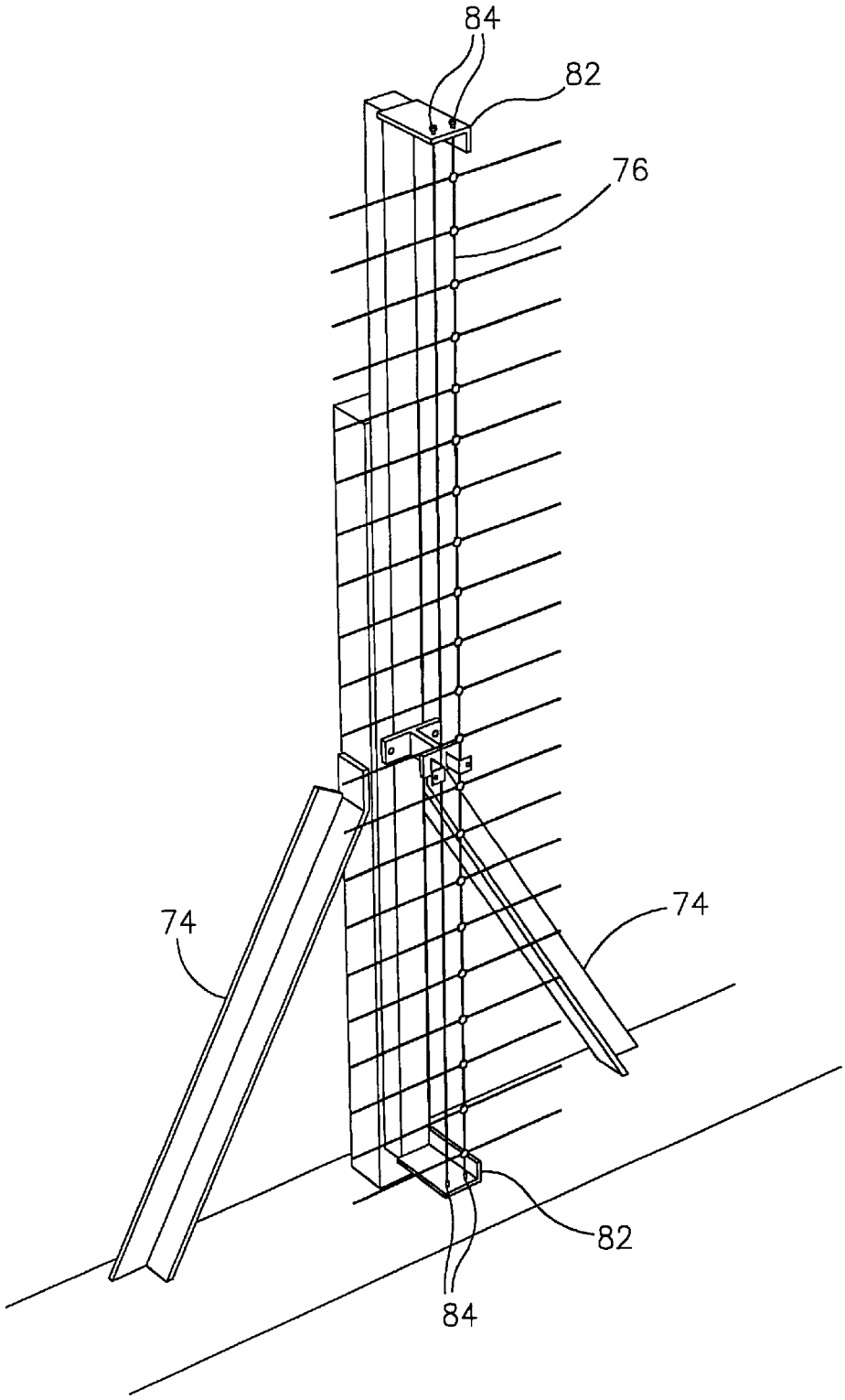
FIG. 5 is an isometric illustration of a preferred embodiment of a detector post of the detection system of FIG. 4.
Figure 6:
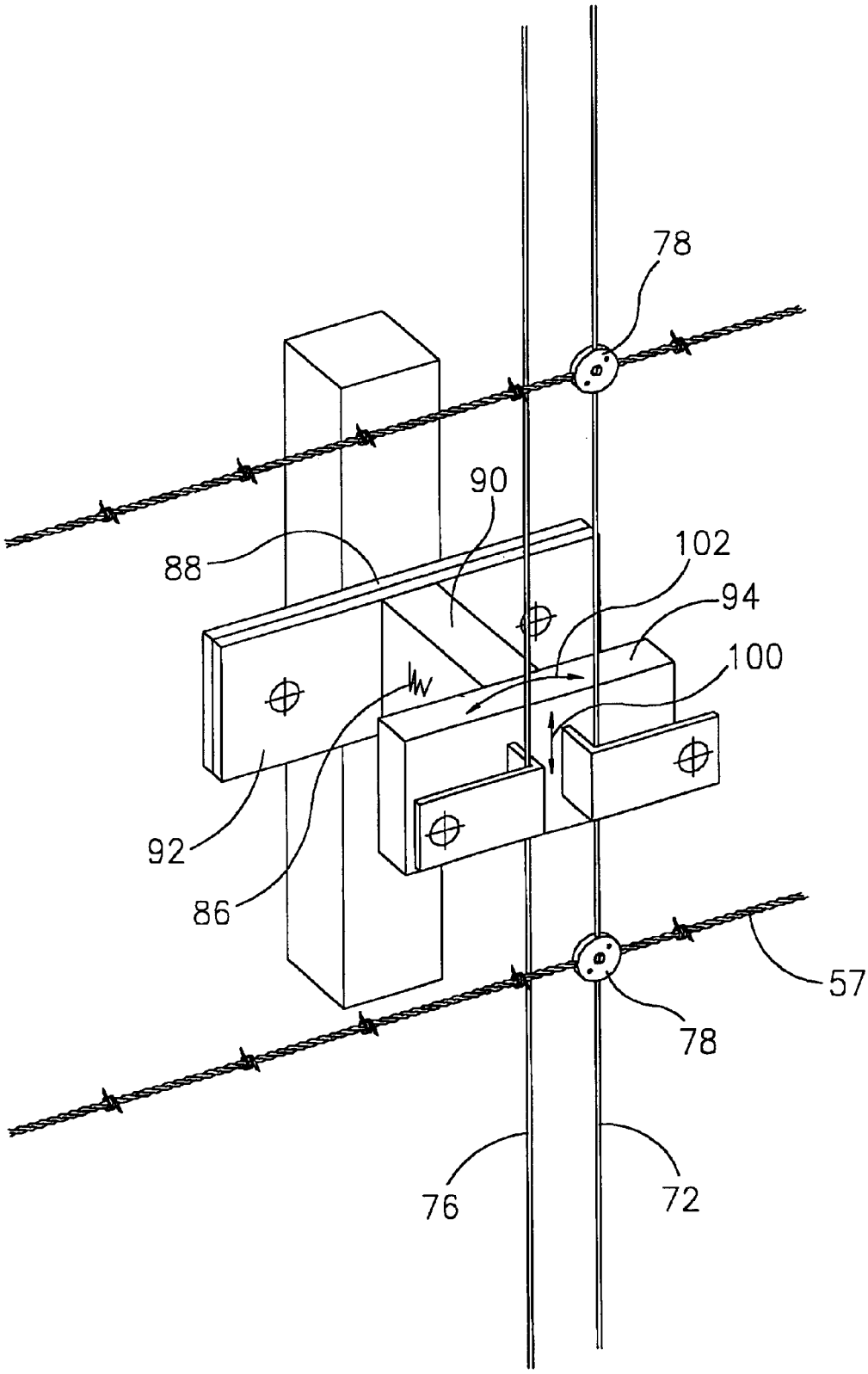
FIG. 6 is an enlarged detail illustrating the connection of the actuator wire to the detector post of FIG. 5.

Reference is now made to FIGS. 5 and 6 which illustrate a preferred embodiment of a detector post, generally designated 70. FIG. 5 is an isometric illustration of detector post 70 and FIG. 6 is an enlarged detail illustrating the connection of the actuator wire 72 to the detector post 65.

Elements of this embodiment of the invention which are similar to elements which have been previously described with respect to the preferred embodiment hereinabove, are similarly designated and will not be further described.

Detector post 70 is anchored to the ground and supported by means of a pair of struts 74, suitable attached to the detector post 70. In this preferred embodiment, each detector post 70 supports a first active (or sensitive) common actuator wire, referenced 72, and a second passive (or non-sensitive) wire 76 (best seen in FIG. 6).

Common actuator wire 72 and passive wire 76 are parallel to each other and both the common actuator wire 72 and passive wire 76 are suitably attached to each end of detecting post 65 by use of upper and lower restraining brackets 82. The tension of the common actuator wire 72 and passive wire 76 are adjustable by means of tensioner bolts 84 fitted to the lower restraining bracket 82 and attached to both common actuator wire 72 and passive wire 76.

Common actuator wire 72 is attached to each of the taut trip wires 52 by means of a pair of clamping discs 78 suitably fitted together so as to tightly grin the trip wire 52 to the common actuator wire 72.

In this embodiment, a detecting device 86 is suitably attached to the detector post 70. Detecting device 86 consists of a torque sensitive detector housed within the central leg 90 of a generally "I" shaped (when viewed in plan) housing 88. Housing 88 further comprises a bottom leg 92 which is configured to accept a pair of bolts (not shown) for attaching to the detector post 70 and a top leg 94.

A pair of clamps 96 and 98 are suitably attached to top leg 94 to allow or clamping common actuator wire 72 and passive wire 76, respectively.

An intrusion or an attempt to force the taut wires 52 apart causes the common actuator wire 72 to move vertically (indicated by arrow 1000. Since the passive wire 76 is not attached to the taut wires 52, passive wire 76 is not affected. The net movement generated by the common actuator wire 72 results in the top leg 94 being rotated (indicated by arrow 102) and the consequent torque being detected by the torque sensitive sensor of detected device 86.

An advantage of this embodiment is that the detecting device 86 is not affected by changes in temperature. Since there are a pair of parallel wires (common actuator wire 72 and passive wire 76) which are clamped to the detecting device 86, any vertical movement (arrow 100) in the parallel wires owing to temperature changes are equal. Thus, temperature changes do not result in any torque movement of top leg 94 and the torque sensitive sensor of detecting device 86 is not activated.

Figure 7:
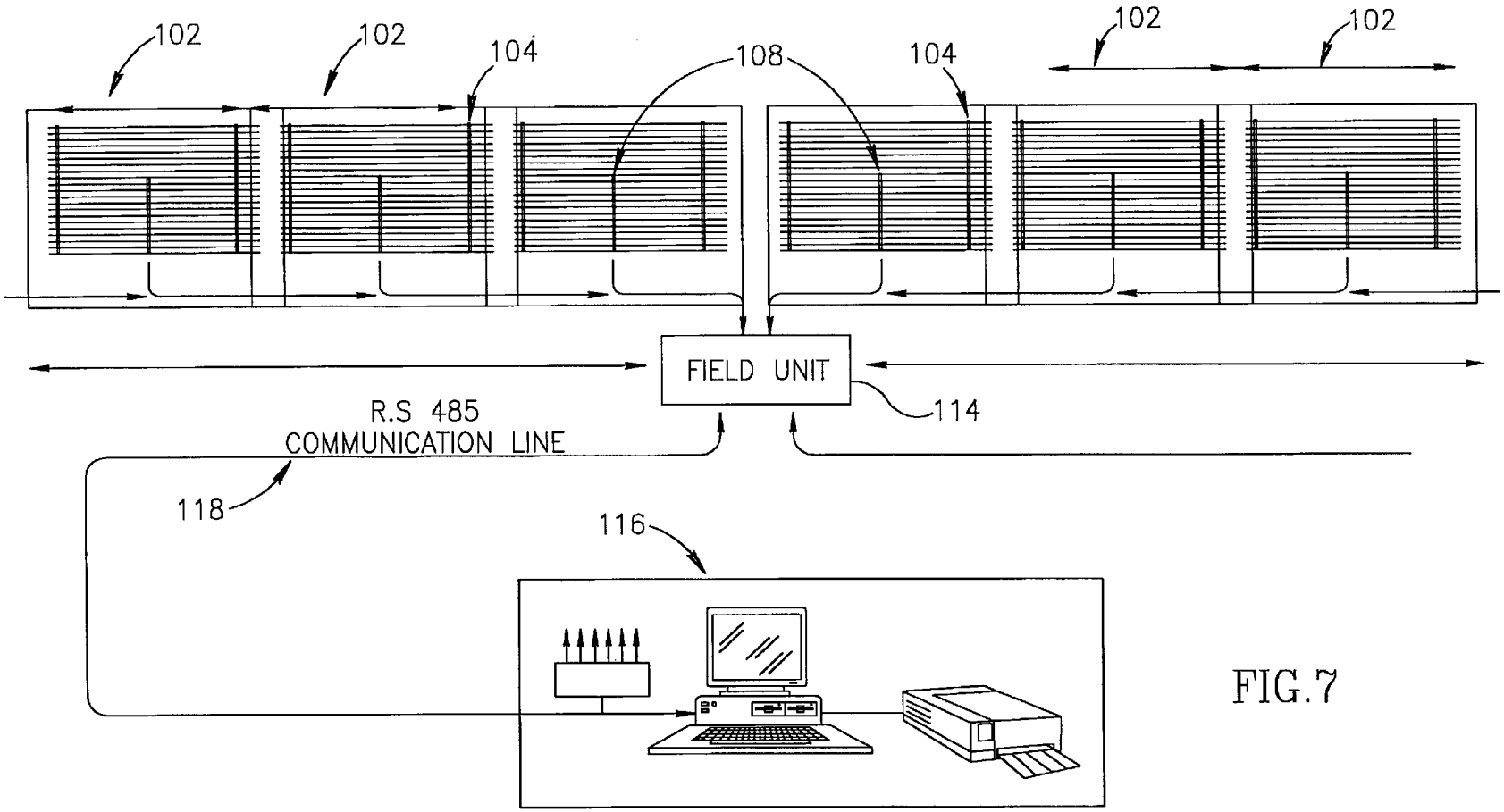
FIG. 7 is a schematic illustration of a detection system, constructed and operative in accordance with a further embodiment of the present invention.
Figure 8:
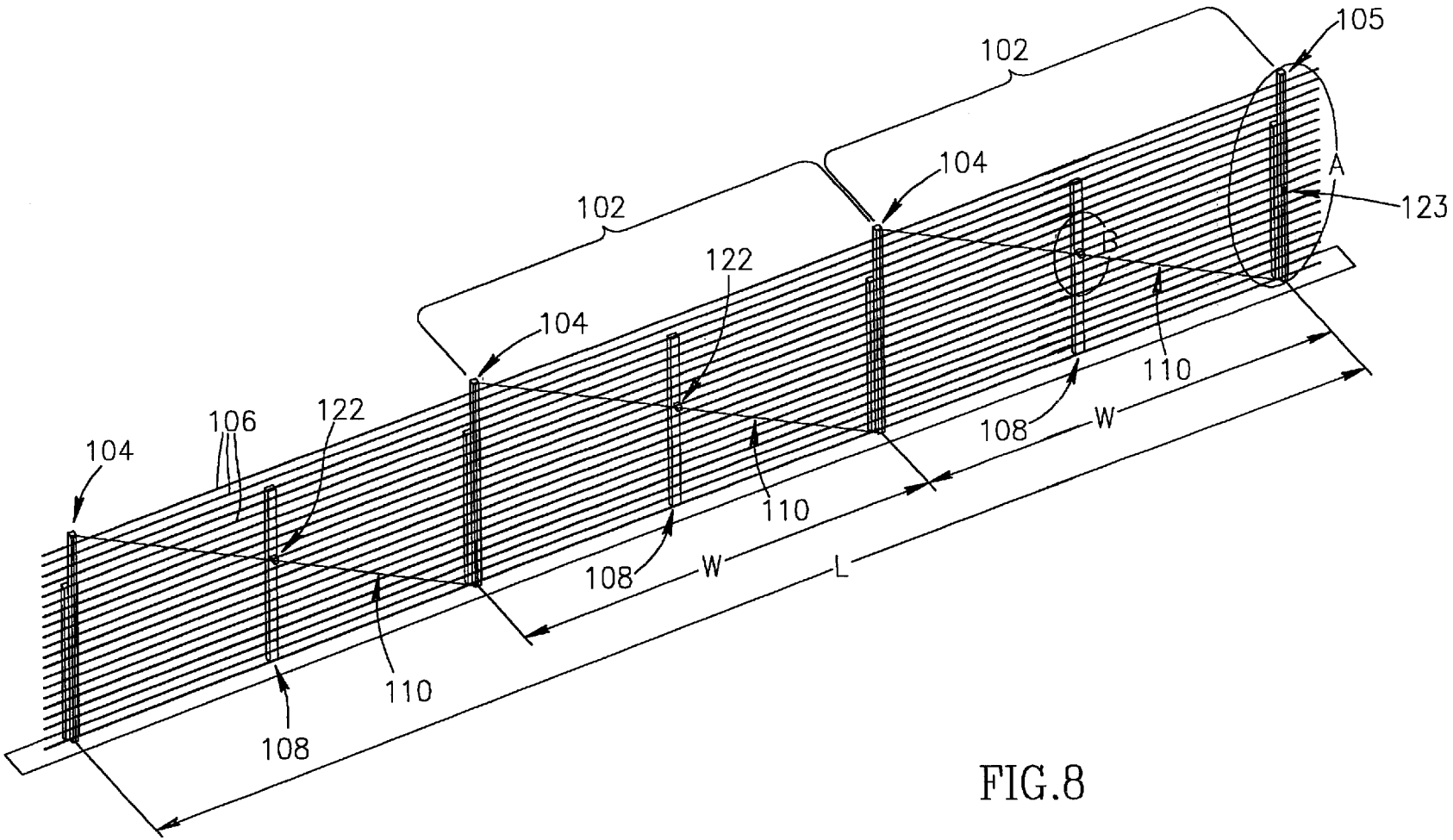
FIG. 8 is an enlarged detail of the detection system of FIG. 7.

Reference is now made to FIGS. 7–10. FIG. 7 is a schematic illustration of a detection system, generally indicated 100, constructed and operative in accordance with a further embodiment of the present invention FIG. 8 is an enlarged detail of the detection system 100.

Figure 9:
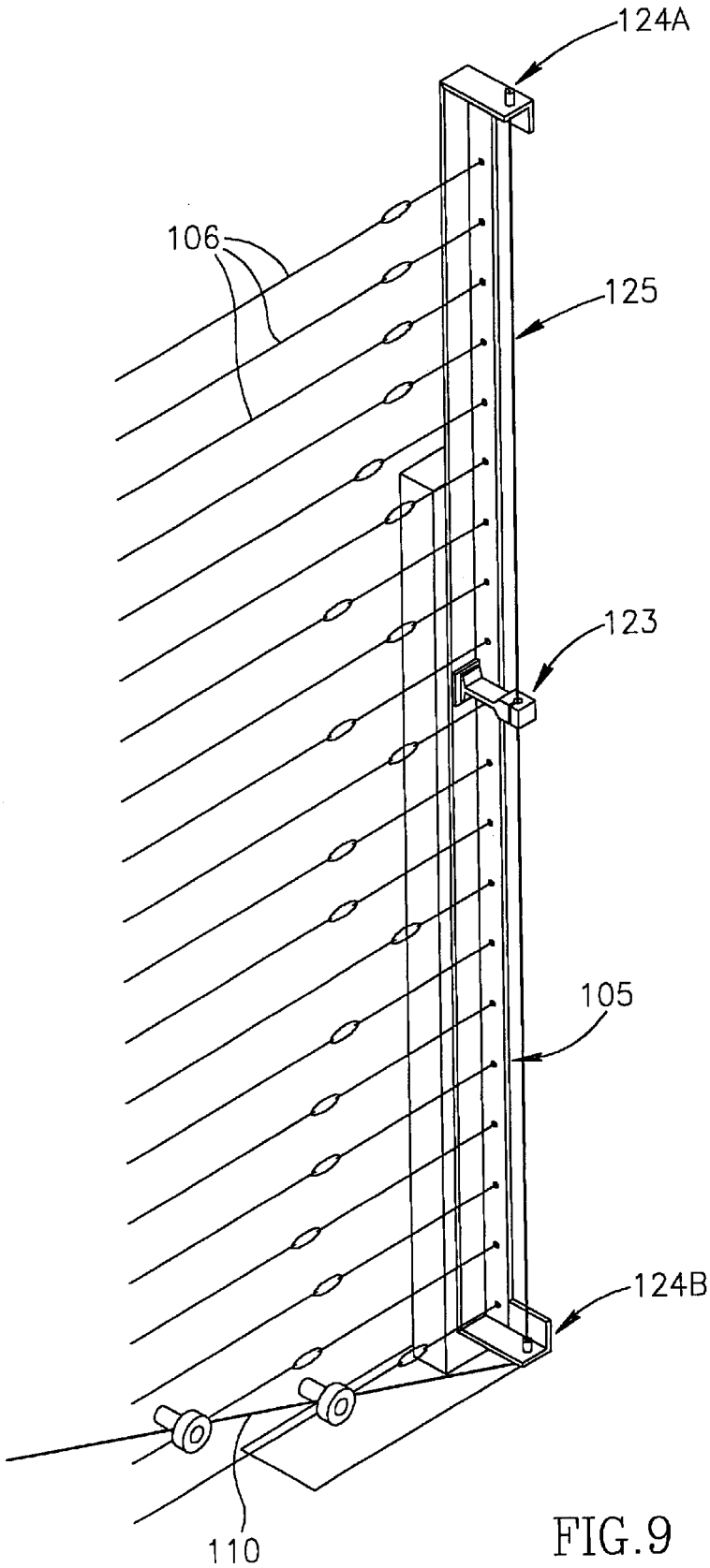
FIG. 9 is an isometric illustration of an anchor post of the detection system of FIG. 7.
Figure 10:
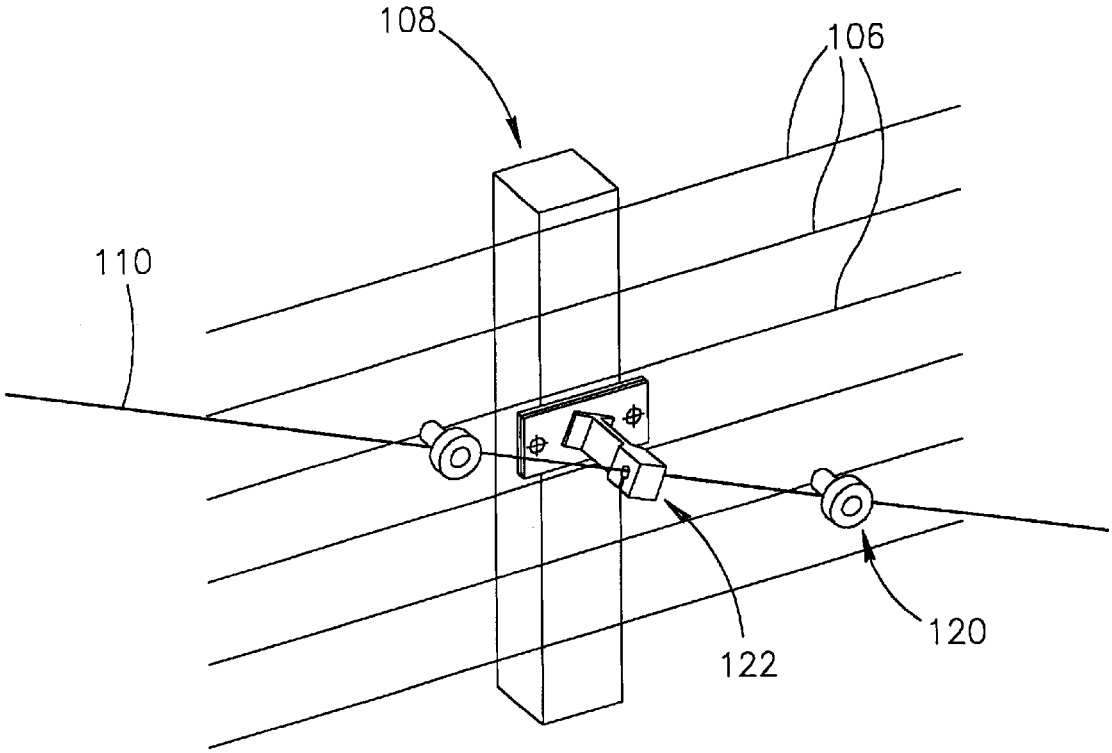
FIG. 10 is an enlarged detail illustrating the connection of the actuator wire to the detector post of the detection system of FIG. 7.

FIG. 9 is an enlarged detail (reference A In FIG. 8) isometric illustration of the anchor post 108 and FIG. 10 is an enlarged detail (reference B In FIG. 8). illustrating the connection of the actuator wire 110 to the detector post 108.

Elements of this embodiment of the invention which are similar to elements which have been previously described with respect to the preferred embodiment hereinabove, are similarly designated and will not be further described.

Detection system 100 comprises a plurality of fence units, generally referenced 102, having a plurality of trip wires 106 which are tautly secured between a pair of anchor posts 105 at either end (only one is shown in FIG. 8 for clarity). Each fence unit 102 comprises a pair of guiding posts 104 through which the plurality of trip wires 106 slide through. A detector post 108 is located between each pair of guiding posts 104. Anchor posts 105, guiding posts 108 and detector post 108 are preferably fixed to the ground to prevent movement.

Each detector post 108 has at least one detecting device 122 attached therto. The detecting device 122 is connected to at least one common actuator wire 110. The common actuator wire 110 is attached to each of the taut trip wires 106 by any suitable means, such as a clip device 120 which is itself suitably connected to the trip wires 106.

In the exemplary embodiment, each common actuator wire 110 travels from the top restraining bracket **124*t* of one of the pair of guiding posts 104, diagonally downwards towards the bottom restraining bracket 124*b* of the second of the pair of guiding posts 104. Each common actuator wire 110 is tensioned between the guiding posts 104. Thus, each guiding post has a common actuator wire 110** fixed to its top and bottom.

For the purposes of illustration only, detector post 108 is located. approximately mid-way between each guiding post 104.

In an exemplary embodiment, the distance (W) between guiding posts 104 is 6 meters. A plurality of the fence units 102 are each coupled to one of a plurality of field units (or local control center) 114, which are situated a distance L along the fence line. In this exemplary embodiment, a local field unit is located along every 100 mn of fence line. Each of the local field units 114 are suitably connected to a control center 116, preferably via a RS 485 communications line 118.

In a further alternative embodiment, a detecting device 123 is suitably carried by anchor posts 105. A second actuator wire 125 is suitably fixed and tensioned between the top and bottom of the anchor post 105 by the use of restraining brackets 124 (or similar).

Alternatively, the common actuator wire 110 attached to the bottom of one of the anchor posts 105 may be continued vertically through detecting device 123 along the anchor post 105 and fixed to the top restraining bracket. Similarly, the common actuator wire 110 attached to the top of the second anchor post 105 may be continued vertically down through detecting device 123 along the anchor post 105 and fixed to its bottom restraining bracket.

In another alternative embodiment, the second actuator wire 125 comprises two separate wires, one wire fixed to the top restraint 124 and the detecting device 123 and the second wire fixed to the bottom restraint 124 and detecting device 123.

Alternatively, a detecting device is fixed to the anchor posts 105.

Preferably, common actuator wire 110 can be adjusted for tension by attaching at least its lower end to a threaded pin (not shown), for example, so that by rotating the pin tension can be applied to the common actuator wire 110.

The detecting devices 122 and 123 can be any suitable device, (such as the device 90 described hereinabove with respect to FIG. 6), which provides high sensitivity with a wide dynamic range, such as a strain gauge, which outputs an electrical signal proportional to the force applied. or piezoelectric devices.

The detecting devices 122 is preferably preset within a pre-determined operating range so that any change in the tension (plus or minus), due to cutting the wire or spreading it apart, will actuate at least one of the detecting devices 122.

The detecting devices 123 attached to the anchor post 105 senses any strain applied to the anchor post 105 due to an intruder climbing the anchor post 105.

The detector posts 108 are located a relatively short distance apart, to ensure that any vertical motion of the wires (owing to intrusion attempts to force the wires apart) is detected by the detecting devices 122) attached to the detector posts 108. Thus, the control center 116 (connected to local field units 114 to which the detecting devices 122 are connected) can accurately identify the location of the attempted intrusion.

As described hereinabove with respect to FIGS. 4–6, the detector posts 108 are sensitive to any movement. In addition, whenever there is tampering with the wires 106, there is a direct actuation of the detecting devices 122 close to the location of the intrusion attempt.

Detecting devices 122 and 123 are any suitably device such as the torque sensitive sensor detecting device (referenced 86, described hereinabove with respect to FIG. 6).

It will be appreciated by persons skilled in the art that the present invention is not limited to what has been particularly shown and described hereinabove. Rather the scope of the present invention is defined only by the claims which follow.

What is claimed is:

1. An intrusion detection fence, comprising:

a plurality of trip wires secured between a pair of anchor posts;

a plurality of detector posts anchored in the ground, located between said anchor posts;

at least one actuator attached to each of said detector posts, said at least one actuator also being attached to each of said plurality of trip wires;

a detecting device attached to said at least one actuator and secured to each of said detector posts;

wherein deflection or cutting of any of said plurality of trip wires activates at least one of said detecting devices adjacent to said activated trip wires.

2. A fence according to claim 1, wherein deflection of any of said plurality of trip wires activates each of the detecting devices either side of the activated trip wires.

3. A fence according to claim 1, wherein said at least one actuator is an actuating wire tensioned between the ends of said detector post.

4. A fence according to claim 1, wherein said at least one actuator is an actuator bar or flange.

5. A fence according to claim 1 and further comprising:

a passive wire attached to each of said detecting device, said passive wire being parallel to said at least one actuator.

6. A fence according to claim 5 wherein said detecting device is housed within a central leg of a generally "I" shaped housing, said housing further comprising a bottom leg and a top leg attached to said central leg.

7. A fence according to claim 6 wherein said housing further comprises a pair of clamps attached to said top leg for clamping common actuator wire and passive wire to said detecting device.

8. A fence according to claim 1 wherein said detecting device is a torque sensitive device.

9. A fence according to claim 1, and further comprising a plurality of guiding posts, each guiding post being located between each pair of detecting posts or between a anchor post and a detecting post.

10. A fence according to claim 9, wherein said at least one actuator is an actuating wire tensioned between the top of one of said guiding posts and the bottom of the adjacent guiding post.

11. A fence according to claim 9, wherein said at least one actuator is an actuating wire tensioned between one end of one of said plurality of guiding posts and the end of one of the anchor posts.

12. A fence according to claim 9 and further comprising a second detecting device attached to at least one of said pair of anchor posts.

13. A fence according to claim 12, wherein said actuating wire is further tensioned between the top and bottom ends of said at least one of said pair of anchor posts and attached to said second detecting device.

14. A fence according to claim 12, wherein said actuating wire is further tensioned between the top or bottom end of said at least one of said pair of anchor posts and attached to said second detecting device.

15. A fence according to claim 20, and further comprising a second actuating wire attached to and tensioned between the top and bottom ends of said anchor post and attached to said second detecting device.

16. A fence according to claim 12, further comprising second and third actuating wires, said second actuating wire being tensioned between one end of said at least one of said pair of anchor posts and said third actuating wire being tensioned between the other end of said at least one of said pair of anchor posts.

17. A fence according to claim 12, wherein said second detecting device is a torque sensitive device.

18. An intrusion detection system, comprising:

a fence having:

a plurality of trip wires secured between a pair of anchor posts, a plurality of detector posts anchored in the ground, located between said anchor posts;

at least one actuator attached to each of said detector posts, said actuator also being coupled to each of said plurality of trip wires;

a detecting device attached to said at least one actuator and secured to each of said detector posts; and a control center coupled to each of said detecting devices, said control center comprising:

a processor for determining and indicating the location of detecting device activated by the deflection of any of said trip wires.

19. A system according to claim 18, wherein defelection of any of said trip wires activates each of the detecting devices either side of the activated trip wires and wherein said processor determines and indicates the location of said intrusion.

20. A system according to claim 18, wherein said at least one actuator is an actuator bar or flange.

21. A system according to claim 18, wherein said at least one actuator is an actuating wire tensioned between the ends of said detector post.

22. A system according to claim 18 and further comprising:

a passive wire attached to each of said detecting device, said passive wire being parallel to said at least one actuator.

23. A system according to claim 22 wherein detecting device is housed within a central leg of a generally "I" shaped housing, said housing further comprising a bottom leg and a top leg attached to said central leg.

24. A system according to claim 23 wherein said housing further comprises a pair of clamps attached to said top leg for clamping common actuator wire and passive wire to said detecting device.

25. A system according to claim 18 wherein said detecting device is a torque sensitive device.

26. A system according to claim 18, and further comprising a plurality of guiding posts, each guiding post being located between each pair of detecting posts or between a anchor post and a detecting post.

27. A system according to claim 26, wherein said at least one actuator is an actuating wire tensioned between the top of one of said guiding posts and the bottom of the adjacent guiding post.

28. A system according to claim 26, wherein said at least one actuator is an actuating wire tensioned between one end of one of said plurality of guiding posts and the end of one of the anchor posts.

29. A system according to claim 26, and further comprising a second detecting device attached to at least one of said pair of anchor posts.

30. A system according to claim 29, wherein said actuating wire is further tensioned between the top and bottom ends of said at least one of said pair of anchor posts and attached to said second detecting device.

31. A system according to claim 29, wherein said actuating wire is further tensioned between the top or bottom end of said at least one of said pair of anchor posts and attached to said second detecting device.

32. A system according to claim 29, and further comprising a second actuating wire attached to and tensioned between the top and bottom ends of said anchor post and attached to said second detecting device.

33. A system according to claim 29, further comprising second and third actuating wires, said second actuating wire being tensioned between one end of said at least one of said pair of anchor posts and said third actuating wire being tensioned between the other end of said at least one of said pair of anchor posts.

34. A system according to claim 29, wherein said second detecting device is a torque sensitive device.

* * * * *